US006970163B2

(12) United States Patent
Cairns et al.

(10) Patent No.: US 6,970,163 B2
(45) Date of Patent: Nov. 29, 2005

(54) FRAME RATE CONTROLLER

(75) Inventors: Graham Andrew Cairns, Oxford (GB); Michael James Brownlow, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 169 days.

(21) Appl. No.: 10/092,372

(22) Filed: Mar. 5, 2002

(65) Prior Publication Data

US 2002/0126083 A1 Sep. 12, 2002

(30) Foreign Application Priority Data

Mar. 10, 2001 (GB) ..... 0105971

(51) Int. Cl.[7] ..... G09G 5/00
(52) U.S. Cl. ..... 345/213; 345/204; 345/211
(58) Field of Search ..... 345/98, 204, 211–213; 315/169.1, 169.3

(56) References Cited

U.S. PATENT DOCUMENTS

| | | | | |
|---|---|---|---|---|
| 5,446,840 A | | 8/1995 | Kiuchi et al. | 395/164 |
| 5,712,652 A | | 1/1998 | Sato et al. | |
| 5,812,149 A | | 9/1998 | Kawasaki et al. | |
| 5,991,883 A | | 11/1999 | Atkinson | 713/300 |
| 6,054,980 A | * | 4/2000 | Eglit | 345/204 |
| 6,211,859 B1 | * | 4/2001 | Lin et al. | 345/596 |
| 6,239,781 B1 | * | 5/2001 | Fujisawa | 345/691 |
| 6,353,435 B2 | * | 3/2002 | Kudo et al. | 345/204 |
| 6,396,465 B1 | * | 5/2002 | Nakagiri | 345/69 |
| 6,426,594 B1 | * | 7/2002 | Ito | 315/169.1 |
| 6,633,340 B1 | * | 10/2003 | Ohara et al. | 348/536 |

FOREIGN PATENT DOCUMENTS

| | | |
|---|---|---|
| JP | 10-319920 | 12/1998 |
| JP | 2000-047172 | 2/2000 |

OTHER PUBLICATIONS

European Search Report regarding Application No. EP 02 25 1633 dated Sep. 13, 2004.

* cited by examiner

*Primary Examiner*—Alexander Eisen
*Assistant Examiner*—Kimnhung Nguyen
(74) *Attorney, Agent, or Firm*—Renner, Otto, Boisselle & Sklar, LLP

(57) ABSTRACT

A frame rate controller (20) is provided for controlling the frame refresh rate of an active matrix display. The controller (20) comprises a first circuit such as a preloadable synchronous counter (21) which counts vertical synchronization signals VSYNC and supplies an enable signal FE for every Nth frame of data, where N is an integer greater than zero and is selectable. A gating arrangement (26) is controlled by the enable signal FE so that an active matrix display is refreshed for every Nth frame of data, thus allowing a reduction in power consumption of the display.

29 Claims, 14 Drawing Sheets

(a)

(b)

Active matrix display with integrated drivers and frame rate controller

FRAME RATE CONTROLLER

BACKGROUND OF THE INVENTION

1. Field of the Invention

The present invention relates to a controller for controlling the frame refresh rate of an active matrix display. The present invention also relates to a display controller including such a frame rate controller and to an active matrix display including such a controller. Such displays may be used in portable equipment where data may be supplied to the display in a variety of formats and where it is desired to minimise display power consumption.

2. Description of the Related Art

FIG. 1 of the accompanying drawings shows a typical active matrix liquid crystal display of known type. The display comprises an active matrix 1 of N rows and M columns of picture elements (pixels). Each pixel comprises a pixel electrode 2 facing a counter electrode (not shown) with a layer of liquid crystal material (not shown) therebetween. The pixel electrode is connected to the drain of a pixel thin film transistor (TFT) 3, whose source is connected to a data line 4, which is common to all of the pixels of a column, and whose gate is connected to scan line 5, which is common to all of the pixels of a row.

The data lines 4 are connected to a data line driver 6, which receives timing, control and data signals from a data controller (not shown) and which supplies analogue voltages for charging the data lines 4. The scan lines 5 are connected to a scan line driver 7 which is controlled by the timing signals and which supplies scan line pulses to the scan lines 5 one at a time in a cyclically repeating sequence.

Image data are transmitted to the data driver on a frame by frame basis. Within each frame, image data are transmitted line by line with each line of data corresponding to the required display states of a horizontal row of pixels of the display. The lines of data are loaded one at a time into the data line driver 6 which charges the data lines 4 to the required voltages. The scan line driver 7 then supplies a scan pulse to the row of pixels to be updated. The pixel transistors 3 of the row receive the scan pulse at their gates and are switched to a conductive state so that the voltages on the data lines 4 charge the pixel electrodes 2 of the line being refreshed. This is repeated row by row until the whole display has been refreshed by a fresh frame of data. This is then repeated for each frame of data.

FIG. 2 of the accompanying drawings illustrates a typical liquid crystal display controller 10 in the form of an integrated circuit which is generally physically separate from the display. The controller 10 comprises a timing generator 11 which receives clock signals (CKS), horizontal synchronisation signals (HS) and vertical synchronisation signals (VS). The timing generator 11 passes these timing signals to the display and generates timing signals for controlling the operation of the display controller 10.

The controller 10 is capable of receiving video data in either luminance and chrominance format (Y, Cr, Cb) or in RGB (red, green, blue) format. A matrix 12 converts the chrominance format data into RGB format data. An on-screen display mixer 13 receives the RGB data either from the matrix 12 or directly from an RGB input and mixes this as desired with on-screen data from an external static random access memory (SRAM) 14 so that any on-screen display data overwrite the video data. The RGB outputs of the mixer 13 are connected to a gamma correction circuit 15, which compensates for the non-linear response of the pixels to voltage and which allows picture adjustments to be made, for example to the colour, brightness and tint of the displayed image.

The RGB outputs of the gamma correction circuit 15 are supplied in parallel digital format to a digital output 16 for use with displays which require digital input video data. For displays which require analogue input data, the outputs of the gamma correction circuit 15 are supplied to a digital/analogue converter (DAC) 17, which converts the red, green and blue image data to corresponding analogue voltage levels. These voltage levels are amplified by an amplifier 18 and supplied to an analogue output 19.

In typical liquid crystal controller integrated circuits, the frequency of the data can be adjusted to the particular requirements of the display. For example, the controller 10 may output data in either SVGA format or XGVA format, which have different data transmission rates for a given frame rate. The frame rate itself is typically fixed to a frequency which is characteristic of the refresh rate required by the liquid crystal material of the display.

In displays which are for use in portable or battery-powered equipment, it is desirable to reduce the power consumption as much as possible so as to prolong battery life and reduce the frequency of replacing batteries. U.S. Pat. No. 5,926,173 discloses a power saving technique for such a display in which, when new image data are sensed as being supplied to the liquid crystal display (LCD), the power supply to the LCD is stopped. U.S. Pat. No. 5,757,365 discloses another power saving technique for display drivers, in which the absence of image data is also sensed. When this is the case, the drivers, which contain a frame memory, operate in a lower power self-refreshing mode.

U.S. Pat. No. 5,712,652 discloses a portable computer having an LCD. This patent specification discloses reducing the refresh rate of a video graphics controller so as to reduce power but does not describe any technique for achieving this.

U.S. Pat. No. 6,054,980 discloses an arrangement for providing frame rate conversion between a computer supplying display data at one frame rate and a display device which cannot operate at such a high frame rate, but in which the supply and display frame rates are not greatly different from each other. This is achieved by the use of a frame buffer in which image data are written at the supply rate and are read at the display rate so that each (N+1)th frame of image data is effectively dumped, where N is an integer greater than zero.

U.S. Pat. No. 5,991,883 discloses a technique for managing power consumption in laptop computers and the like. The display refresh rate is adapted according to the type of images which are to be displayed. A reduced refresh rate is achieved by reducing the processing speed of image data, for example by reducing the pixel clock rate of a video graphics controller.

U.S. Pat. No. 5,446,840 discloses reducing the rate at which video data are supplied so as to take some of the processing burden off the CPU of a computer system running graphical user interfaces. New video data are written to a relatively fast RAM and then refreshing or updating a display device takes place at a relatively slow rate which is just fast enough to avoid undesirable perceptible visual artefacts.

SUMMARY OF THE INVENTION

According to a first aspect of the invention, there is provided a controller for controlling the frame refresh rate of an active matrix display, characterised by comprising: a first circuit responsive to display signals from a display controller for supplying an enable signal for each Nth frame, where N is an integer greater than zero and is selectable from a plurality of values; and a second circuit for enabling refreshing of the display by each Nth frame supplied to the display controller in response to the enable signal and for preventing refreshing of the display by each other frame supplied to the display controller in the absence of the enable signal.

The display signals may include frame synchronisation signals and the first circuit may be responsive to each Nth frame synchronisation signal.

The first circuit may be arranged to supply the enable signal for the duration of each Nth frame.

The second circuit may be arranged to connect the display to a power supply in response to the enable signal and to disconnect the display from the power supply in the absence of the enable signal.

The second circuit may be arranged to gate at least one signal which influences power consumption of the display. The second circuit may comprise at least one gate for connection between the display controller and the display. The at least one gate may comprise at least one logic gate, for example where the display signals are in digital format. The at least one gate may comprise at least one transmission gate, which may for example be used for analogue or digital display signals. The second circuit maybe arranged to gate a memory read control signal of the display controller.

The at least one signal may comprise a frame synchronisation signal from the display controller.

The at least one signal may comprise a line synchronisation signal from the display controller.

The at least one signal may comprise at least one image determining signal from the display controller.

The first circuit may include means for fixing N at a value greater than 1. As an alternative, N may be selectable from a plurality of predetermined or fixed values. As a further alternative, the first circuit may have an input for selecting the value of N.

The first circuit may be a preloadable synchronous counter. The counter may have a terminal count output for supplying the enable signal. The counter may have a load enable input connected to the terminal count output. The counter may have a clock input for receiving frame synchronisation signals from the display controller.

The controller may have a frame rate reduction enable input. The counter may have a count enable input arranged to be enabled by a rate reduction enable signal at the enable input. The count enable input may be connected to the enable input. As an alternative, the count enable input may be connected via a D-type latch and a set/reset flip-flop to the enable input.

According to a second aspect of the invention, there is provided a display controller including a frame refresh rate controller according to the first aspect of the invention.

The enable input may be connected to receive a memory write control signal of the display controller.

According to a third aspect of the invention, there is provided an active matrix display including a controller according to the first aspect of the invention.

The second circuit of the controller may be disposed adjacent an input of the display f or receiving the display signals and may be arranged to gate all of the display signals.

The display may comprise a plurality of data and scan driver integrated circuits, each of which includes a controller according to the first aspect of the invention.

The display may comprise a liquid crystal display.

For displays for mobile products, the image data which are to be displayed may vary significantly, for example from static low colour text to full-colour full-motion video images. The present frame rate controller allows the frame rate, and thus the power consumption, to be set according to the desired image display requirements. This allows the display to consume substantially less power.

For example, for moving picture images, the frame rate controller can be disabled or set such that the display frame rate is the same as the frame rate from a display controller. Thus, the display operates at the nominal frame rate, such as video rate between 60 and 80 frames per second.

Digital images which are transmitted using known compression standards are usually supplied at less than the standard video rate, for example at 15 frames per second. The display can thus be refreshed at 15 frames per second when displaying such images and a substantial reduction in power consumption can be achieved.

For relatively static images such as text, the controller can reduce the frame rate of the display to the minimum level for which no visible flicker is observable. This may, for example, be of the order of 4 frames per second. Thus, an even greater reduction in power consumption can be achieved when displaying such images.

The present controller is relatively simple to implement and requires a relatively small number of electronic components. The controller may thus be included with little or no additional cost and may, for example, be implemented within a poly-silicon integrated circuit driver.

BRIEF DESCRIPTION OF THE DRAWINGS

The present invention will be further described, by way of example, with reference to the accompanying drawings, in which.

Like reference numerals refer to like parts throughout the drawings.

DESCRIPTION OF THE PREFERRED EMBODIMENTS

Figure 1:
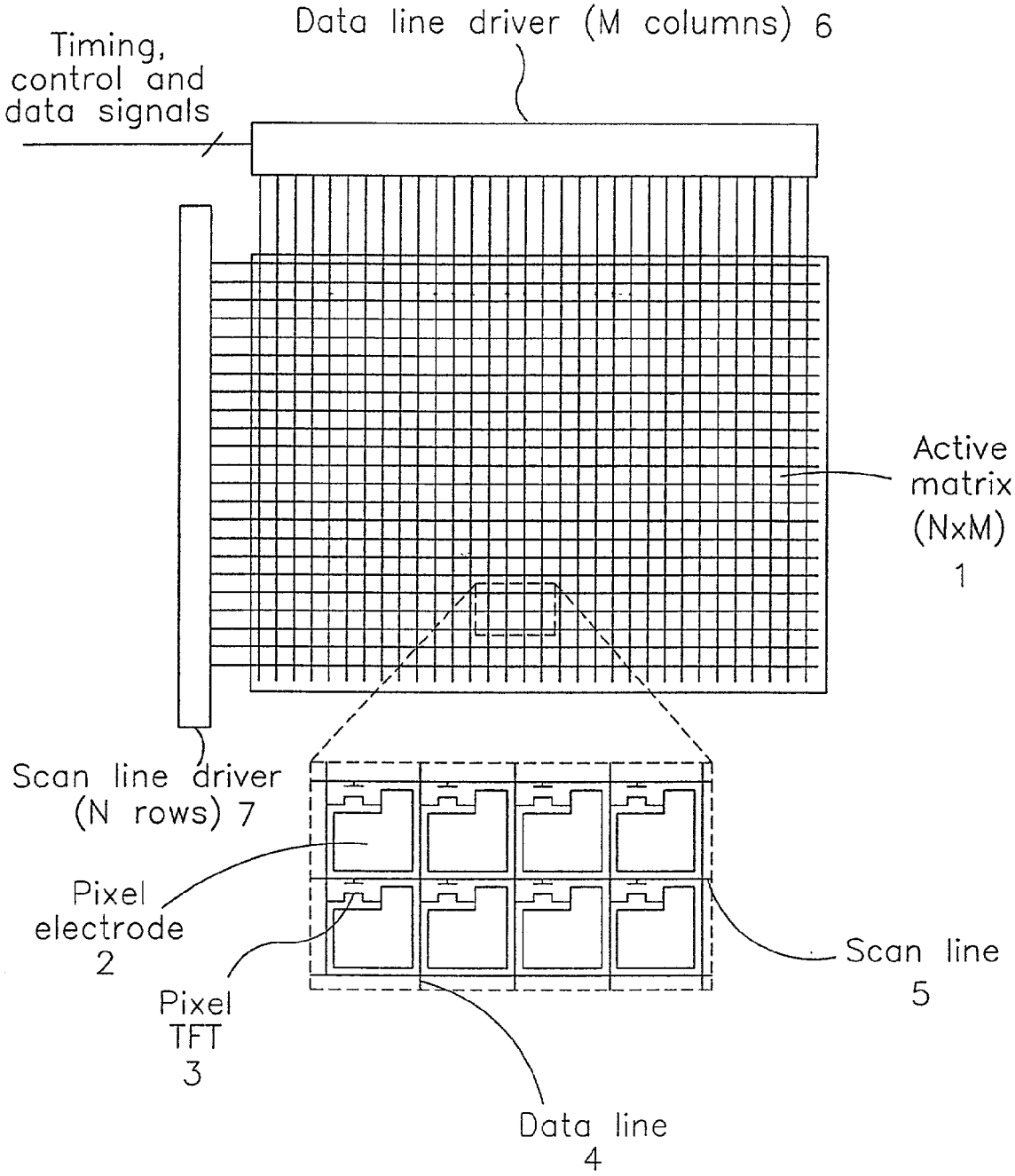
FIG. 1 is a block schematic diagram of a known type of active matrix display.
Figure 2:
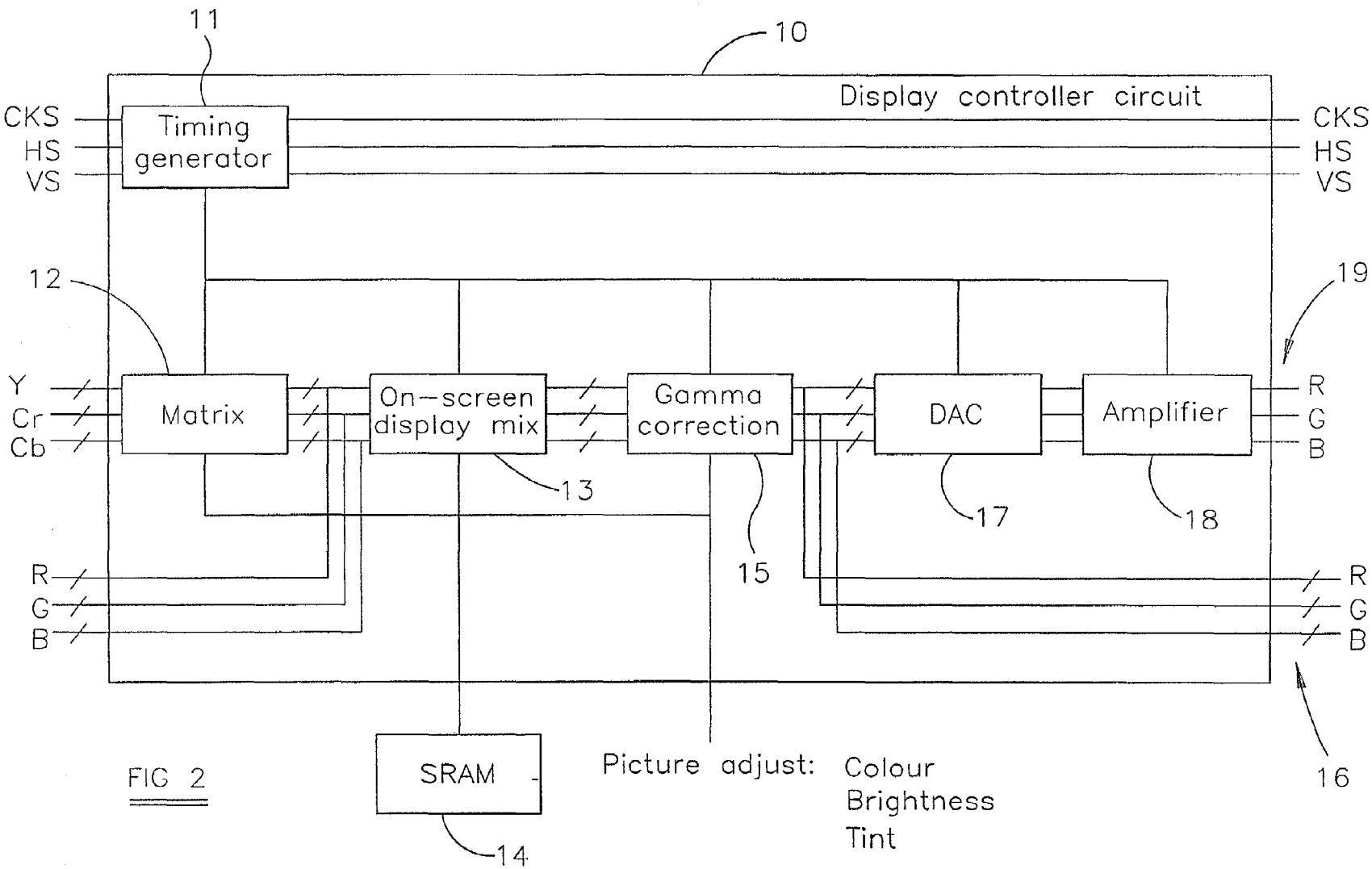
FIG. 2 is a block circuit diagram of a known type of integrated circuit display controller.
Figure 3:
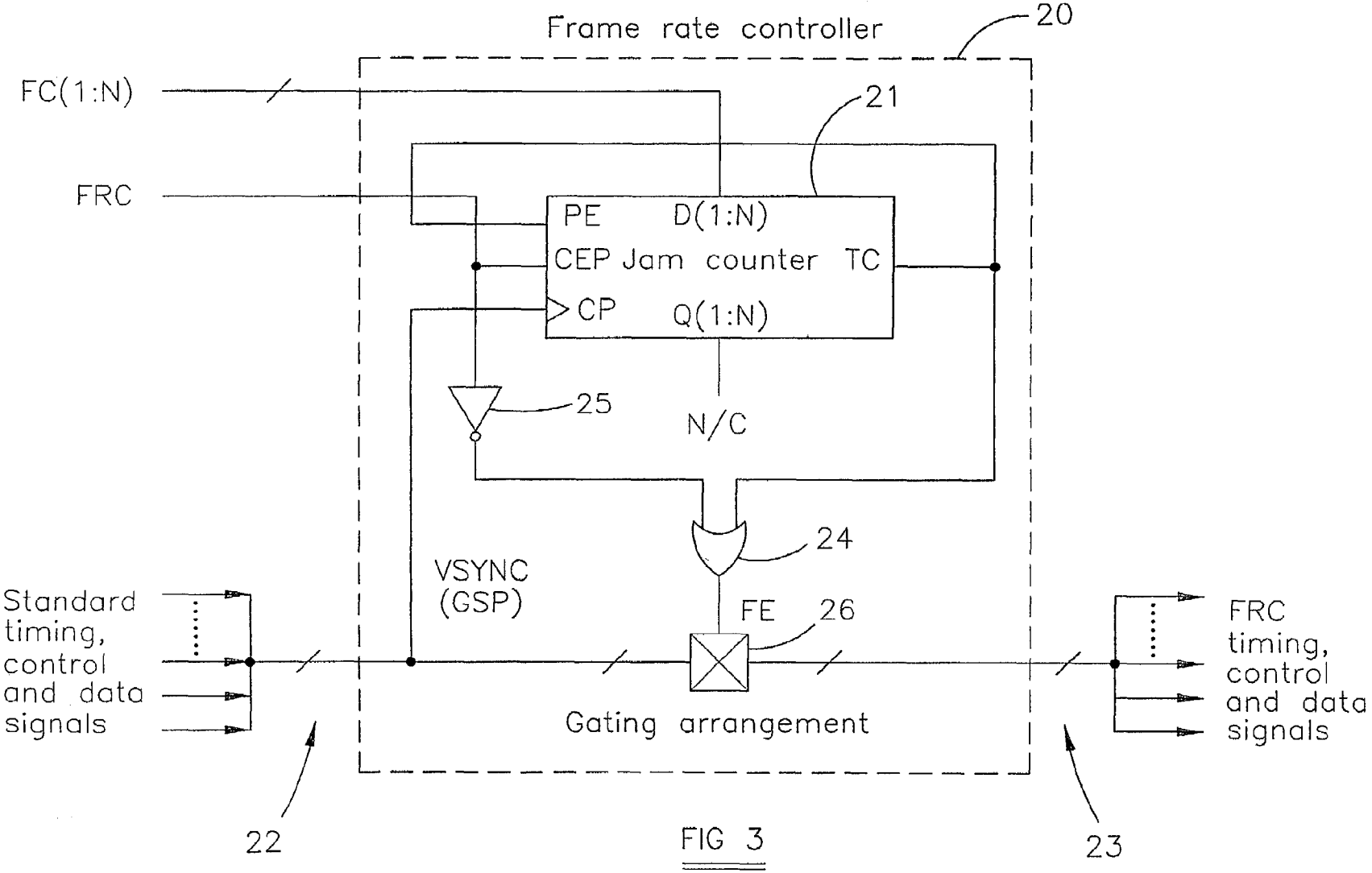
FIG. 3 is a block circuit diagram of a frame rate controller constituting an embodiment of the invention.

The frame rate controller 20 shown in FIG. 3 is for connection at any suitable point between the output of a display controller, for example of the type shown in FIG. 2, and the input of an active matrix display of liquid crystal or other type, for example of the type shown in FIG. 1. The controller 20 comprises a preloadable synchronous or "jam" counter 21 in the form of an N bit binary counter. The controller 20 has parallel multiple inputs 22 and outputs 23 for receiving standard timing, control and data signals from the display controller and for forwarding frame rate controlled timing, control and data signals to the display. The counter 21 has a clock input CP which is connected to a timing line carrying vertical synchronisation signals VSYNC. Such signals are typically used to start the gate or row driver in a flat panel matrix display and these signals are often referred to as the gate driver start pulse GSP. A counter enable input CEP of the counter 21 is connected to receive a frame rate control signal FRC for enabling and disabling frame refresh rate reduction. The counter 21 has data inputs D (1:N) which comprise parallel load inputs enabling a parallel-represented digital number to be preloaded into the counter 21. The data inputs are connected to a frame count input F (1:N) for controlling the frame reduction ratio, which is equal to the input signal frame rate divided by the output signal frame rate. The signals FRC and FC (1:N) are supplied, for example, from circuitry in a device incorporating the display and the controller 20. Such circuitry indicates when frame rate reduction is required and what frame rate reduction ratio is required in accordance with the image signals to be displayed.

The counter 21 has a terminal count output TC which produces a logic high level signal only when the counter 21 reaches its terminal count such that all of its outputs Q (1:N) supply a binary high level or "one" signal. The terminal count output TC is connected to a parallel load enable input PE and to a first input of an OR gate 24, whose output provides a frame enable signal FE. The second input of the gate 24 is connected to the output of an inverter 25 whose input is connected to receive the frame rate control signal FRC. The output of the gate 24 is connected to the control input of a gating arrangement 26, which passes all of the timing, control and data signals from the input 22 to the output 23 in response to the frame enable signal FE and blocks all of the signals in the absence of the frame enable signal FE.

The frame rate controller 20 can be disabled by supplying a logic low level signal as the frame rate control signal FRC. The counter 21 is disabled and the inverter 25 supplies a logic high level signal via the gate 24 to the gating arrangement 26, which thus passes all of the timing, control and data signals from the input 22 to the output 23. Thus, no frame rate reduction occurs and the display refresh rate is governed by the signals supplied by the display controller.

When frame rate reduction is required, the frame rate control signal FRC is at the logic high level so that the counter 21 is enabled. The counter 21 thus counts the vertical synchronisation signals and, when it reaches it maximum or terminal count, the terminal count output TC goes to the logic high level. The parallel load enable input PE is thus enabled and the binary number supplied to the input FC (1:N) is loaded into the counter 21 so as to preset it to the binary number for controlling the frame reduction ratio. The output of the inverter 25 remains at the logic low level for as long as the counter is enabled by the control signal FRC. The next frame or vertical synchronisation signal enables preloading of the counter so that the terminal count output TC goes to the logic low level, the gate 24 applies a logic low level blocks the passage of the timing, control and data signals from the input 22 to the output 23. Refreshing of the display thus stops.

The counter 21 counts each vertical synchronisation pulse until the counter reaches its terminal count. The output TC goes to the logic high level and the gating arrangement 26 is enabled by the frame enable signal FE to begin passing the signals from the input 22 to the output 23. A complete frame of data is passed to the display, which is thus again refreshed by the new frame of image data. When the next vertical synchronisation pulse is received, the counter 21 is reset to the binary value at the input FC (1:N), the gating arrangement 26 is disabled to prevent refreshing of the display, and the process is repeated until the counter 21 next reaches its terminal count.

The frame rate is thus reduced by a factor equal to 1 plus the maximum binary count of the counter 21 minus the binary value at the frame count input FC (1:N). This ratio is equal to $2^N$-FC, where N is the number of stages of the counter 21 and FC is the binary value at the input FC (1:N).

Figure 4:
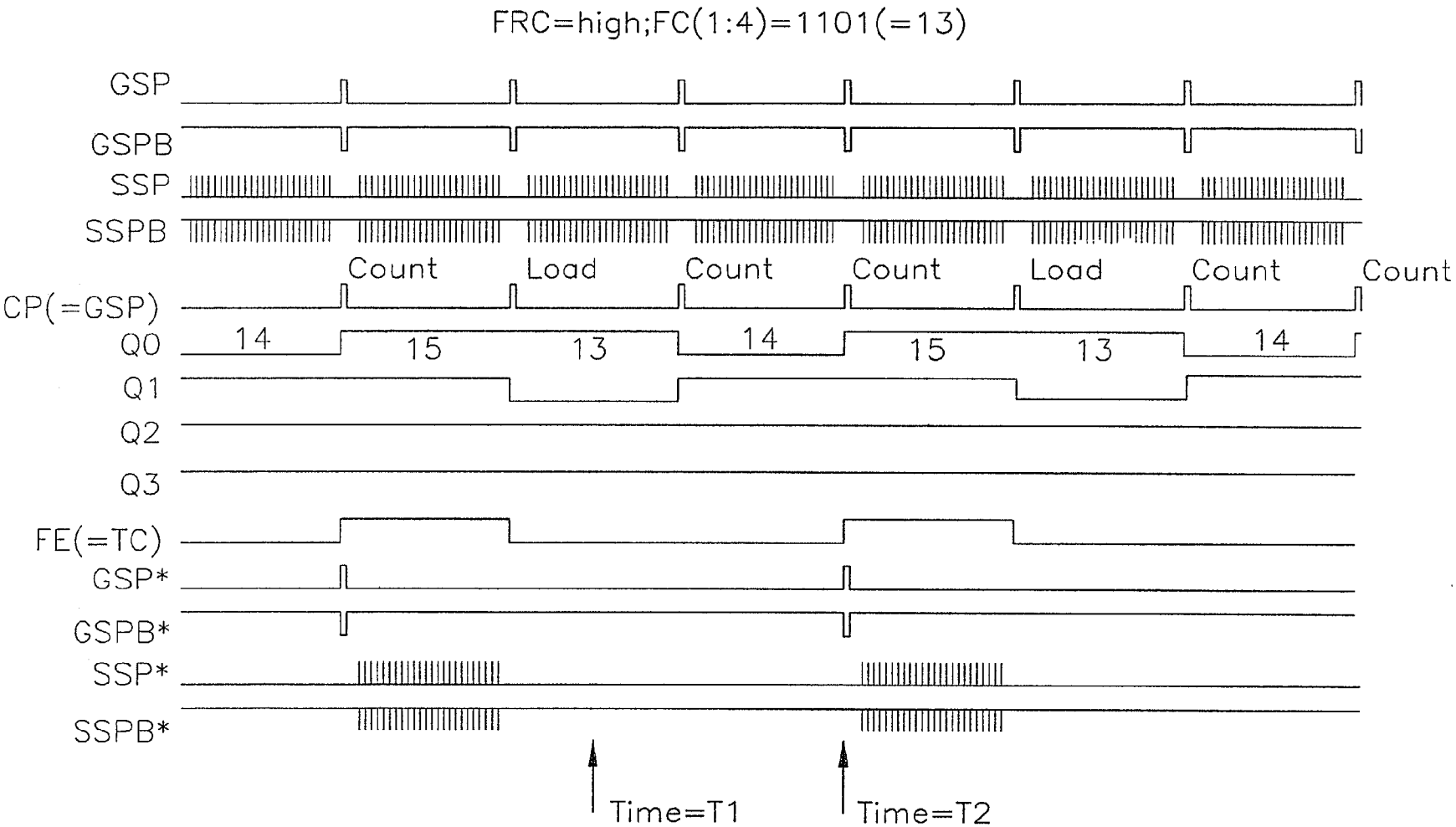
FIG. 4 is a timing diagram illustrating waveforms which occur in the controller of FIG. 3.

FIG. 4 illustrates the waveforms occurring in a particular example of the controller 20, in which the counter 21 comprises a 4 bit binary counter (N=4) and the frame count input FC (1:4) receives the binary number 1101 representing a preload of 13. The waveforms illustrated are the gate line start pulse GSP, the complement GSPB thereof, source driver start pulses (line synchronisation pulses) SSP and the complement SSPB thereof, the binary stage outputs Q0 to Q3 of the counter 21, the frame enable signal FE, and the corresponding output pulses GSP*, GSBP*, SSP* and SSPB* appearing at the output 23 of the controller 20.

At time T1, the counter 21 has been preloaded with the binary value 1101 representing 13 so that the terminal count output TC and hence the frame enable signal FE are at the logic low level. When the next pulse GSP is received at the input 22, the counter 21 is incremented to contain the value 14. However, the terminal count output TC remains at the low logic level so that the gating arrangement 26 remains disabled.

At time T2, the next pulse GSP is received and the counter 21 is incremented to its terminal count 15. The enable signal FE thus rises to the high logic level and the gating arrangement 26 is enabled so as to pass all of the display signals to the output 23 and hence to the active matrix display.

Upon receipt of the next signal GSP indicating the start of the next frame refresh cycle, the binary value 1101 is loaded into the counter 21. The output TC and hence the enable signal FE switch to the low logic level so that the gating arrangement 26 is disabled until the counter 21 reaches its terminal count the next time.

This cycle of events is repeated so that only the start signals, line synchronisation signals and image data signals for every third frame are supplied to the display.

Figure 5:
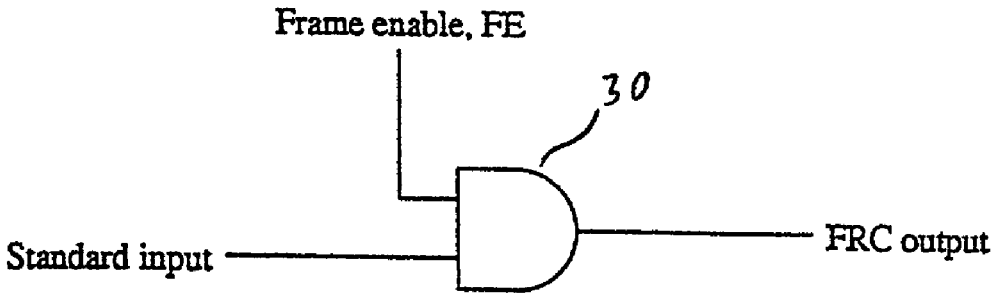
FIG. 5 (comprising FIGS. 5*a* and 5*b*) is a circuit diagram illustrating two types of gating arrangement for use in the controller of FIG. 3.
Figure 5:
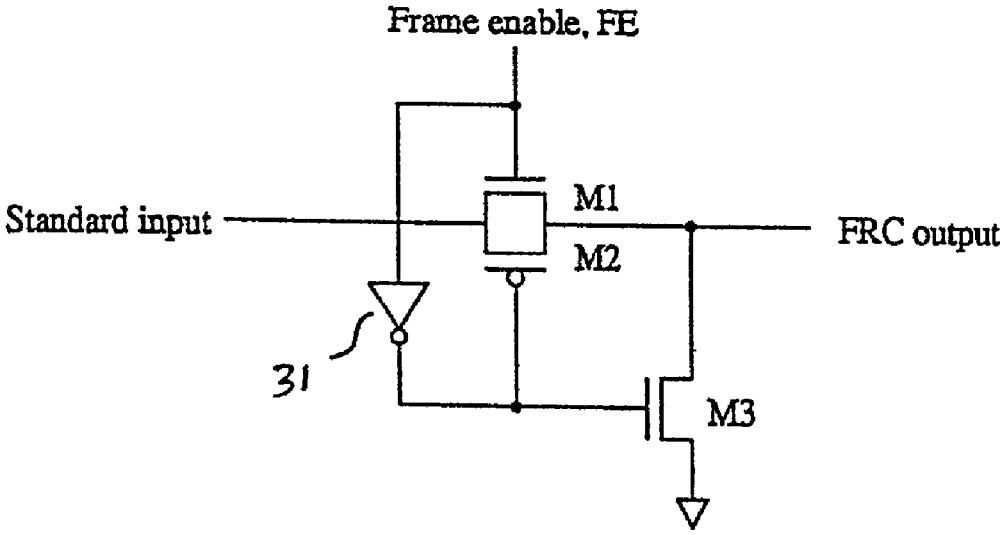

The display may require analogue or digital signals depending on its particular type. In the case where the display requires digital signals, the gating arrangement 26 may comprise a plurality of AND gates 30 as shown in FIG. 5(*a*). Each signal line to be controlled contains such a gate with the standard input supplied to one gate input and the frame enable signal FE supplied to the other input of each gate.

FIG. 5(*b*) shows an alternative arrangement which may be used for analogue (or digital) signals. The arrangement shown in FIG. 5(*b*) is likewise provided in each signal line which is to be controlled and comprises a transmission gate formed by field effect transistors M1 and M2, an inverter 31 and a pull-down field effect transistor M3. For both of the gating arrangements illustrated in FIG. 5, when the arrangement is disabled, the output of the gating arrangement is at the low logic level. However, for displays which require some other level when not being refreshed, other arrangements may be provided, for example so that the display input is held at the logic high level or in a high impedance state.

Although the controller of FIG. 3 has been described as gating all of the signal lines from the display controller to the display, this may not always be necessary. In particular, it is sufficient to control or gate those signal lines which influence the power consumption of the display. For example, it may be sufficient to gate only the vertical synchronisation signals or both the vertical and horizontal synchronisation signals. Also, instead of gating the signals supplied to the display input, it may be possible or appropriate for some displays to control the supply of power to the display such that it is powered only when receiving those frames which are to be used to refresh the display.

Figure 6:
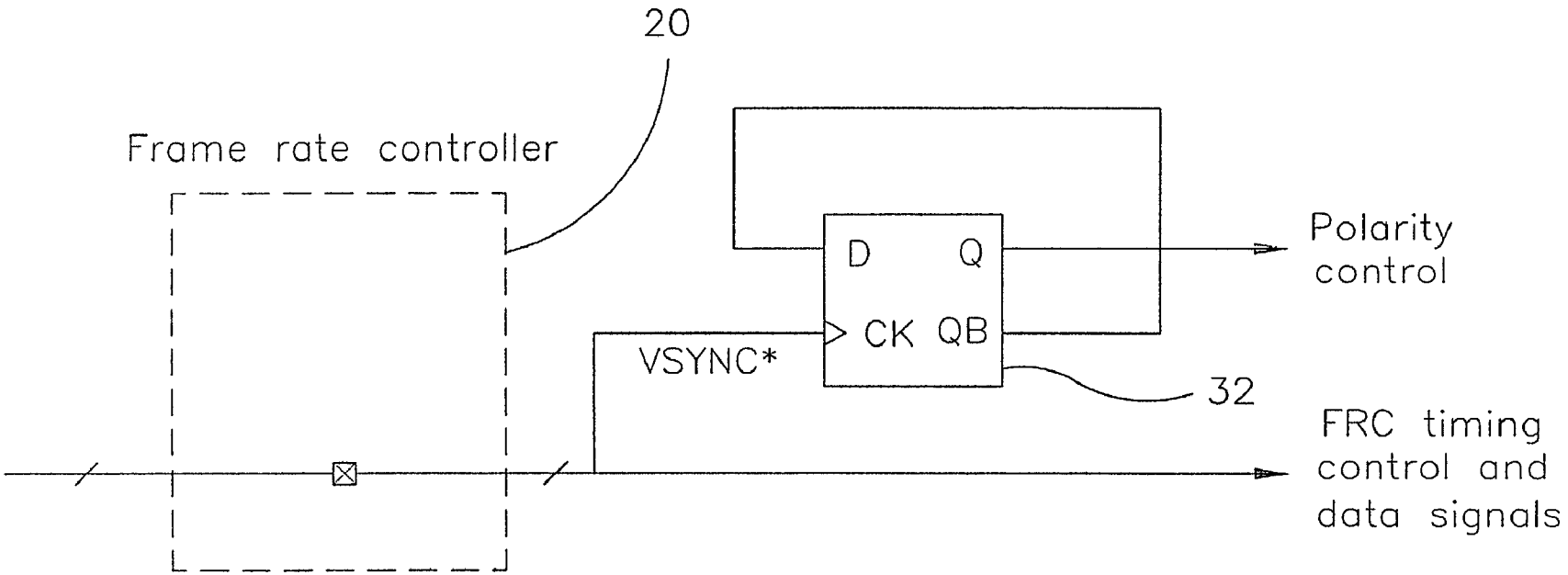
FIG. 6 is a circuit diagram illustrating a polarity inversion control arrangement for an active matrix liquid crystal display.

It is usual for active matrix liquid crystal displays to be AC driven such that the polarity of the voltages supplied to each pixel alternate on a frame by frame basis. Depending on the actual implementation of the controller 20, it may be necessary to ensure that, during reduced frame rate operation, successive video data transmitted to the display are of opposite polarities. For example, this may be achieved by applying only frame rate reduction ratios which are odd numbers. However, an alternative arrangement which allows any frame rate ratio to be used is illustrated in FIG. 6. This arrangement comprises a flip-flop 32 having a clock input CK connected to receive the vertical synchronisation pulses VSYNC* supplied by the frame rate controller 20. The flip-flop 32 has a data input D connected to an inverted output QB and a direct output Q which supplies a polarity control signal to the display so as to control the polarity of the voltages supplied to the pixels of the matrix.

In general, the display controller 10 of FIG. 2 is physically separate from the display and, for example, is implemented as or as part of an integrated circuit. The frame rate controller may also be implemented as a physically distinct device, for example as an integrated circuit which is connected between the display controller and the display. By gating all of the signal lines, this ensures that no power is consumed in charging and discharging the capacitances of the signal and timing paths of the display.

Figure 7:
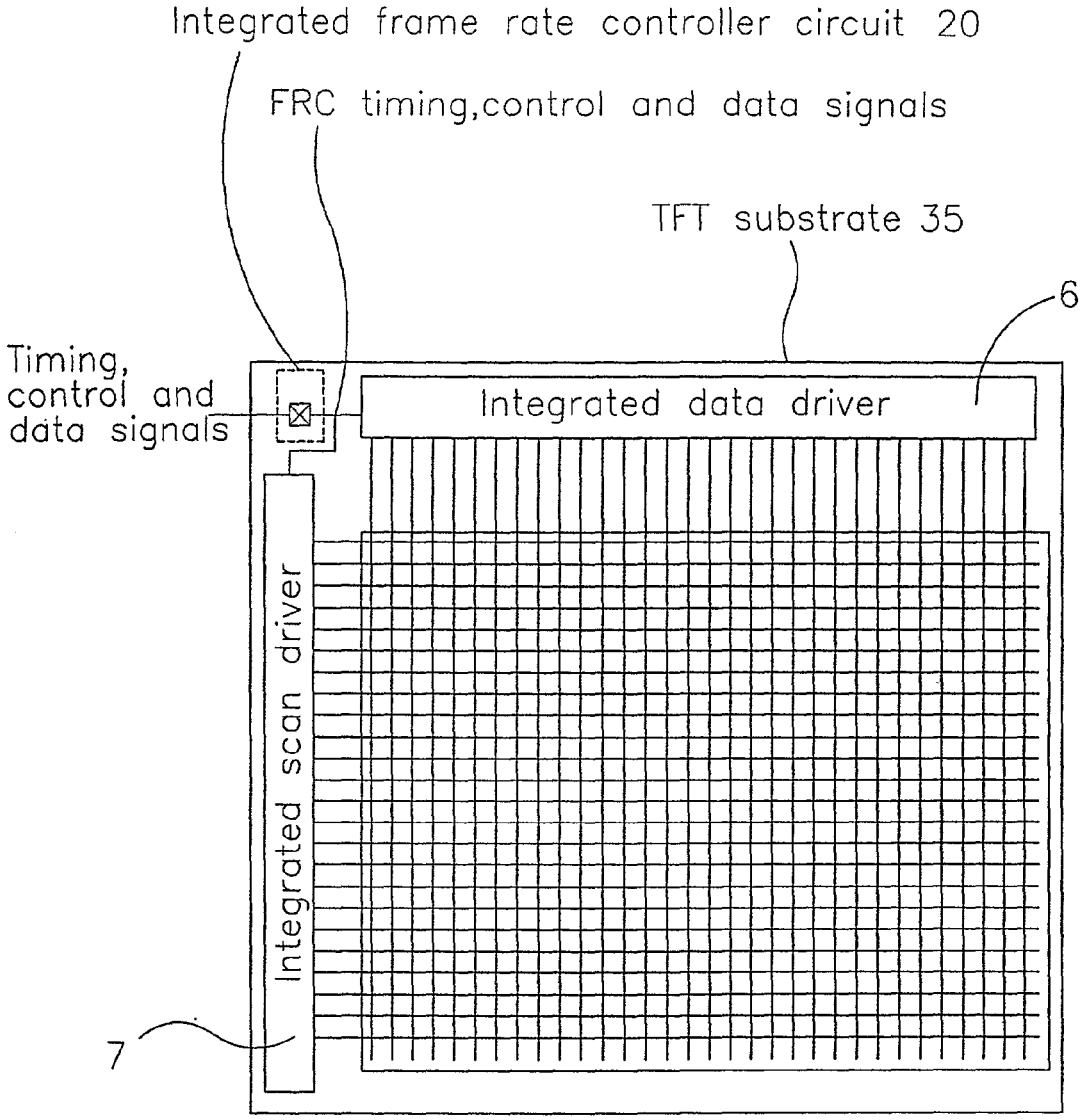
FIG. 7 is a block schematic diagram of an active matrix liquid crystal display constituting another embodiment of the invention.

FIG. 7 illustrates an alternative arrangement, in which the frame rate controller 20 is integrated monolithically on the same substrate as the data and scan drivers 6 and 7, for example using essentially the same thin film transistor (TFT) process on the same substrate 35. The frame rate controller thus controls the signals which are supplied to the drivers 6 and 7 from the input of the display connected to a physically separate display controller.

Figure 8:
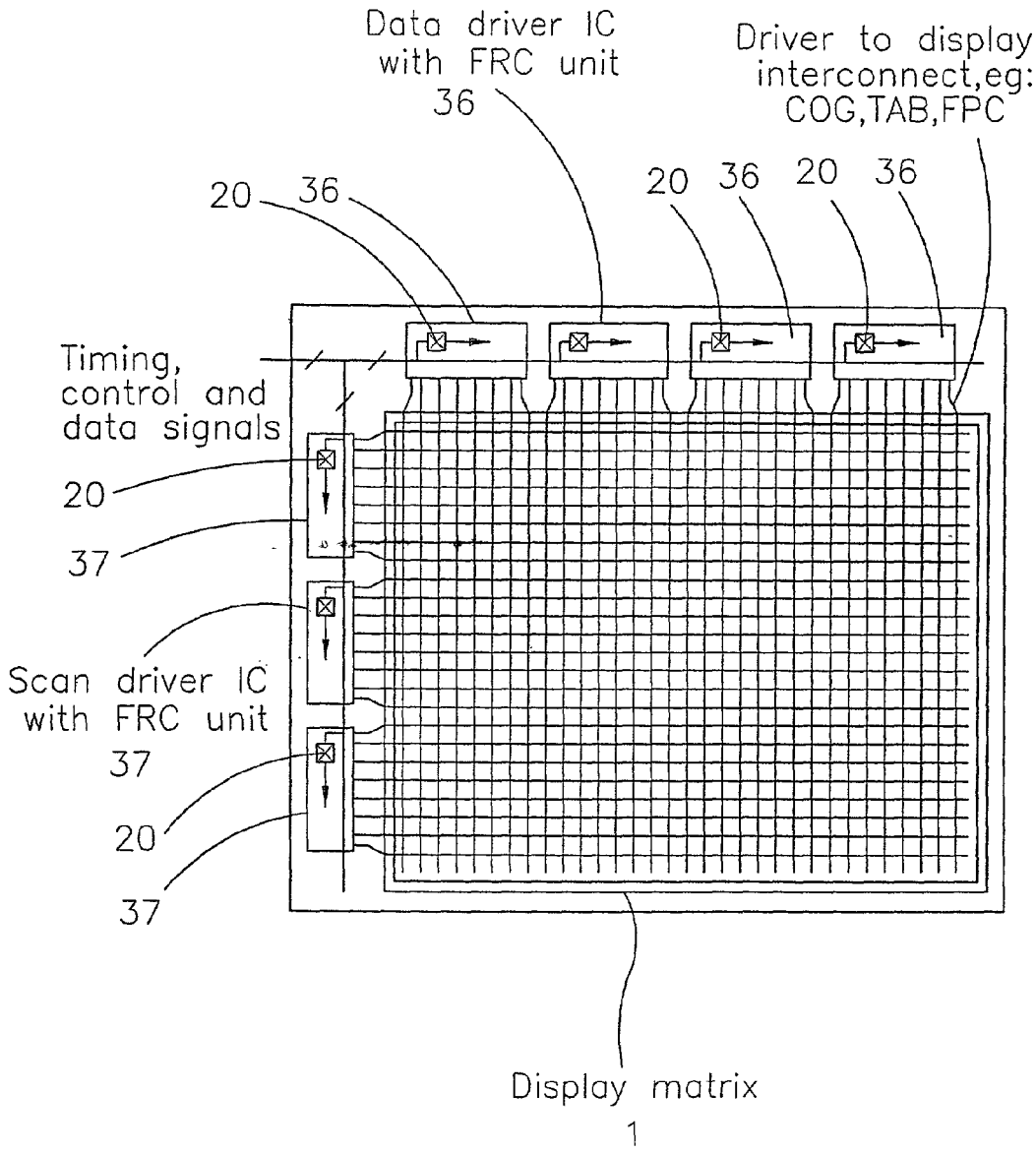
FIG. 8 is a block schematic diagram of an active matrix liquid crystal display constituting a further embodiment of the invention.

FIG. 8 illustrates the type of active matrix display in which the data and scan drivers are implemented as several integrated circuits 36, 37, for example fabricated in crystalline silicon and connected to the active matrix substrate by any suitable means such as direct die-bonding or by flexible connectors. In this embodiment, each of the drivers 36, 37 includes a frame rate controller 20 which is formed within the respective integrated circuit.

Figure 9:
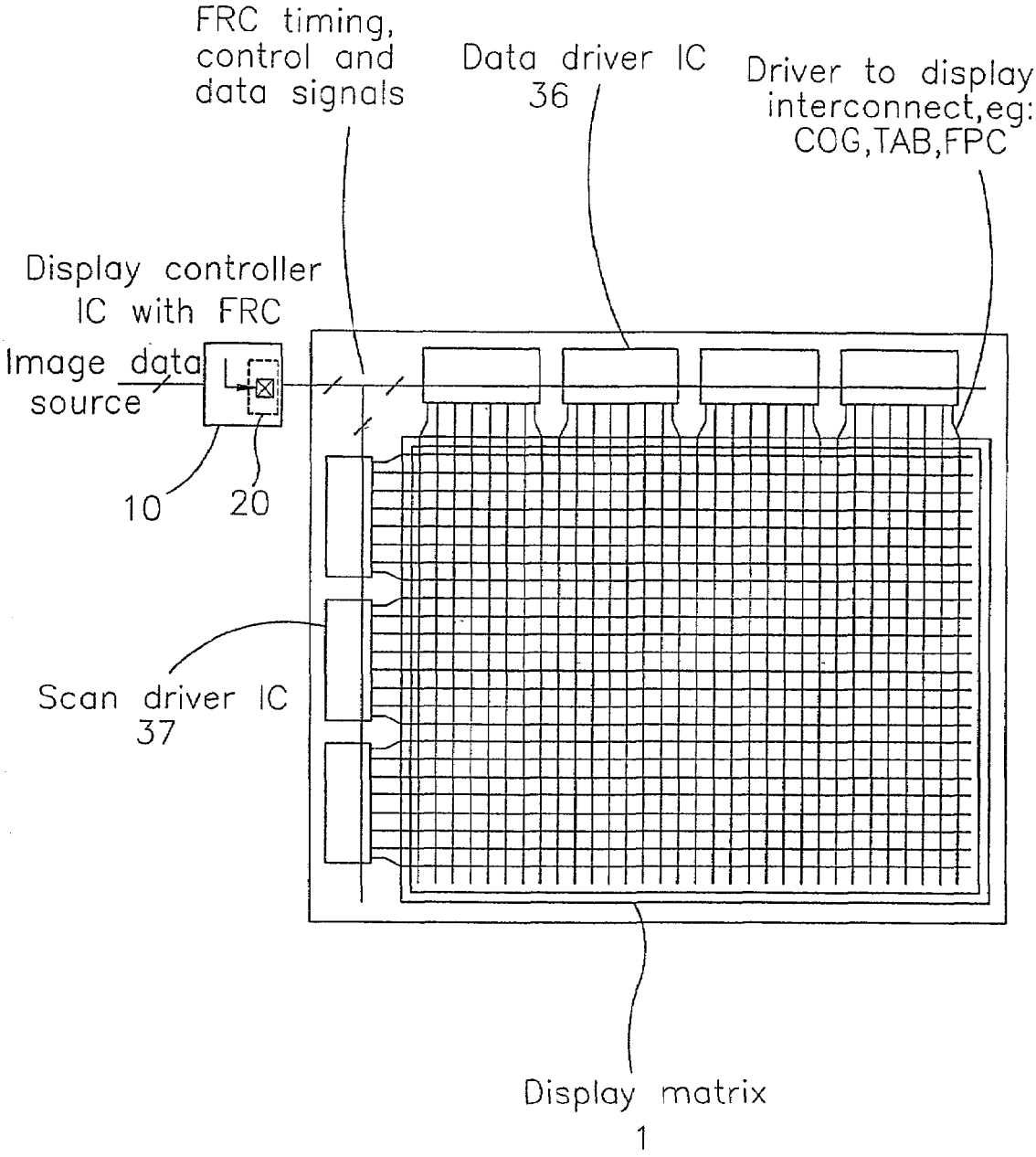
FIG. 9 is a block schematic diagram of an active matrix display and display controller constituting yet a further embodiment of the invention.

FIG. 9 illustrates yet another arrangement in which the frame rate controller 20 is disposed within and forms part of the display controller integrated circuit 10. The drivers 36 and 37 are shown as being of the same type as in FIG. 8 but may alternatively be integrated on the active matrix substrate as illustrated in FIG. 7.

Although the frame rate controller 20 has the capability of reducing the frame rate by any desired number (within a range determined by the maximum capacity of the counter 21) by appropriately programming the value preloaded into the counter 21, some applications may require a single predetermined frame rate reduction ratio. In such cases, the frame rate control input FC (1:N) is not needed and the data inputs D (1:N) of the counter 21 can be hard-wired to the appropriate voltage levels f or the desired reduction ratio. Frame rate reduction may then be achieved by enabling and disabling the counter 21 by means of the frame rate control input FRC.

Where totally flexible programming of frame rate reduction ratios is not required, a switching arrangement may be provided such that the frame rate reduction ratio can be chosen from any of several preset or fixed ratios.

Figure 10A:
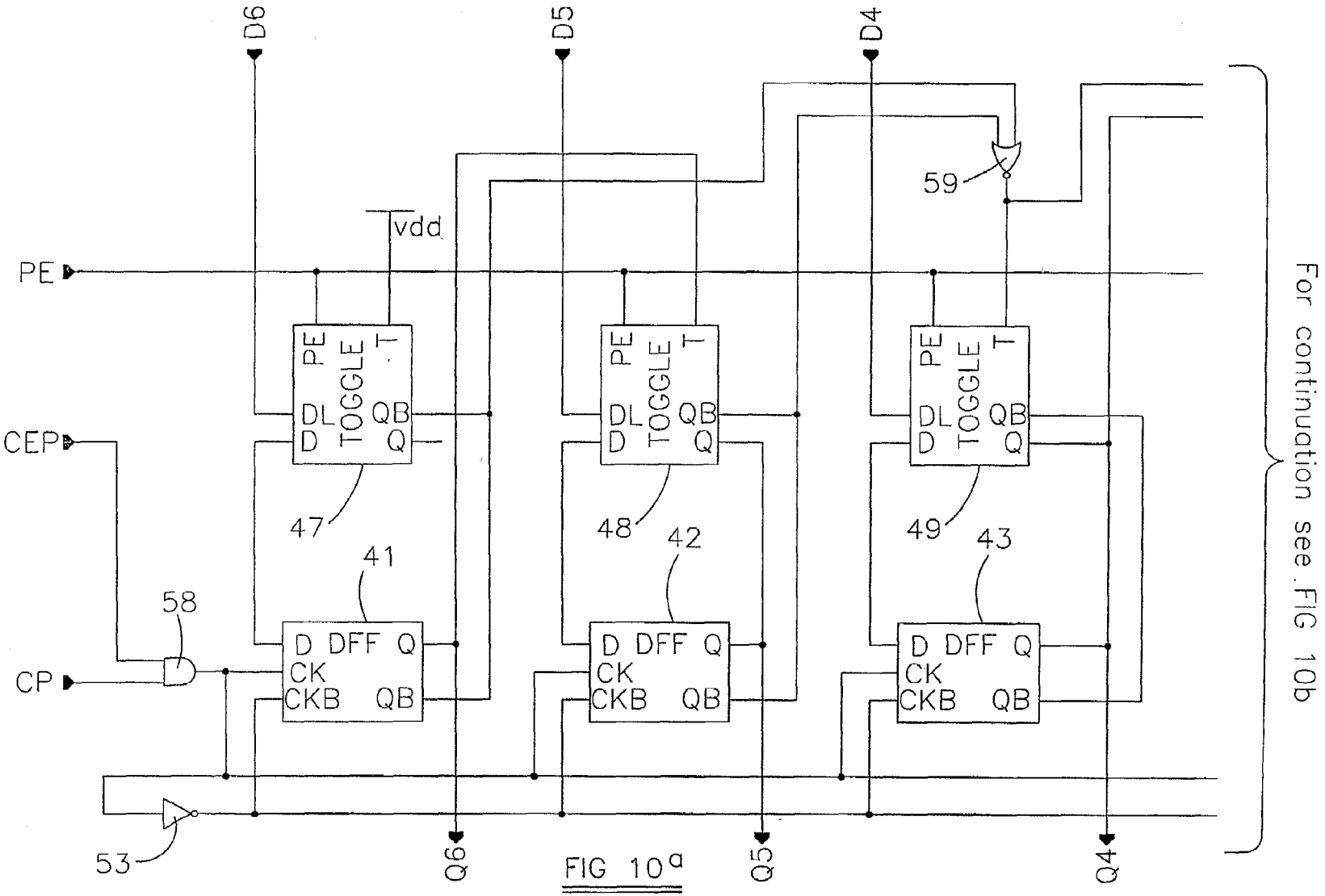
FIG. 10 (comprising FIGS. 10*a* and 10*b*) is a circuit diagram of a jam counter of FIG. 3.
Figure 10B:
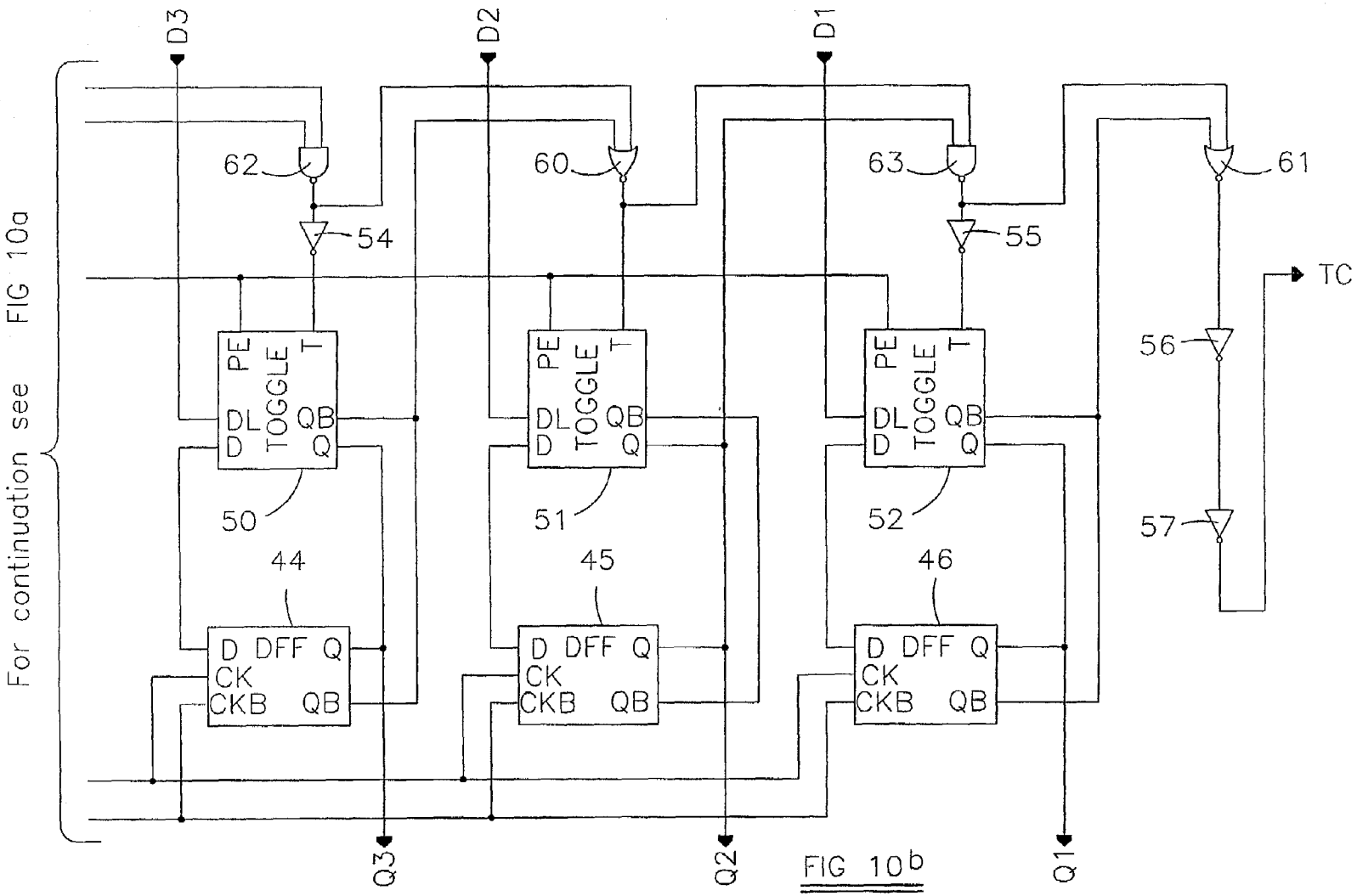

FIG. 10 shows an example of the counter 21 in the form of a six bit preloadable synchronous binary counter (N=6). Each stage of the counter comprises a D-type flip-flop 41–46 and an associated toggle logic block 47–52. The inputs and outputs of the counter 21 are labelled in the same way in FIG. 10 as in FIG. 3 so as to correspond thereto. The counter further comprises inverters 53–57, a two-input AND gate 58, two-input NOR gates 59–61 and two-input NAND gates 62 and 63.

Figure 11:
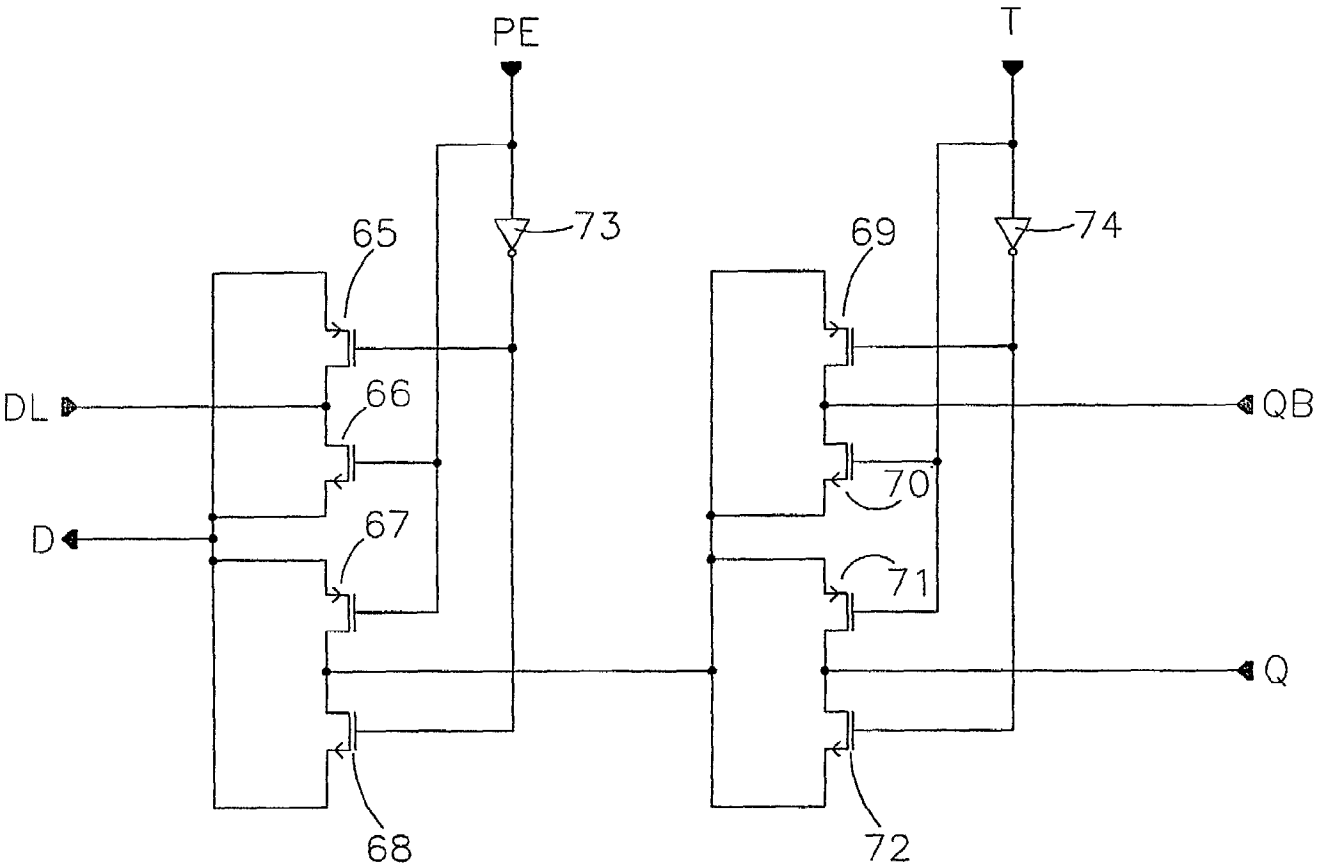
FIG. 11 is circuit diagram of a toggle logic block of FIG. 10.

Each of the toggle logic blocks 47–52 is as shown in FIG. 11 and comprises four transmission gates comprising pairs of CMOS transistors 65,66; 67,68; 69,70; and 70,72 and inverters 73 and 74. Each toggle logic block has a preload enable input PE connected to the input PE of the counter 21 and a toggle input T. Each toggle logic block also has signal inputs DL, QB, and Q and an output D.

When the input PE is at a logic high level, the output D of each toggle logic block receives the signal at the input DL. When the input PE is at the logic low level, the output D receives the signal from the input QB if the signal at the toggle input T is at the high logic level or the signal from the input Q if the signal at the toggle T is at the logic low level.

The construction and operation of the counter 21 illustrated in FIGS. 10 and 11 is readily understood by those skilled in the art and will not be described further.

Figure 12:
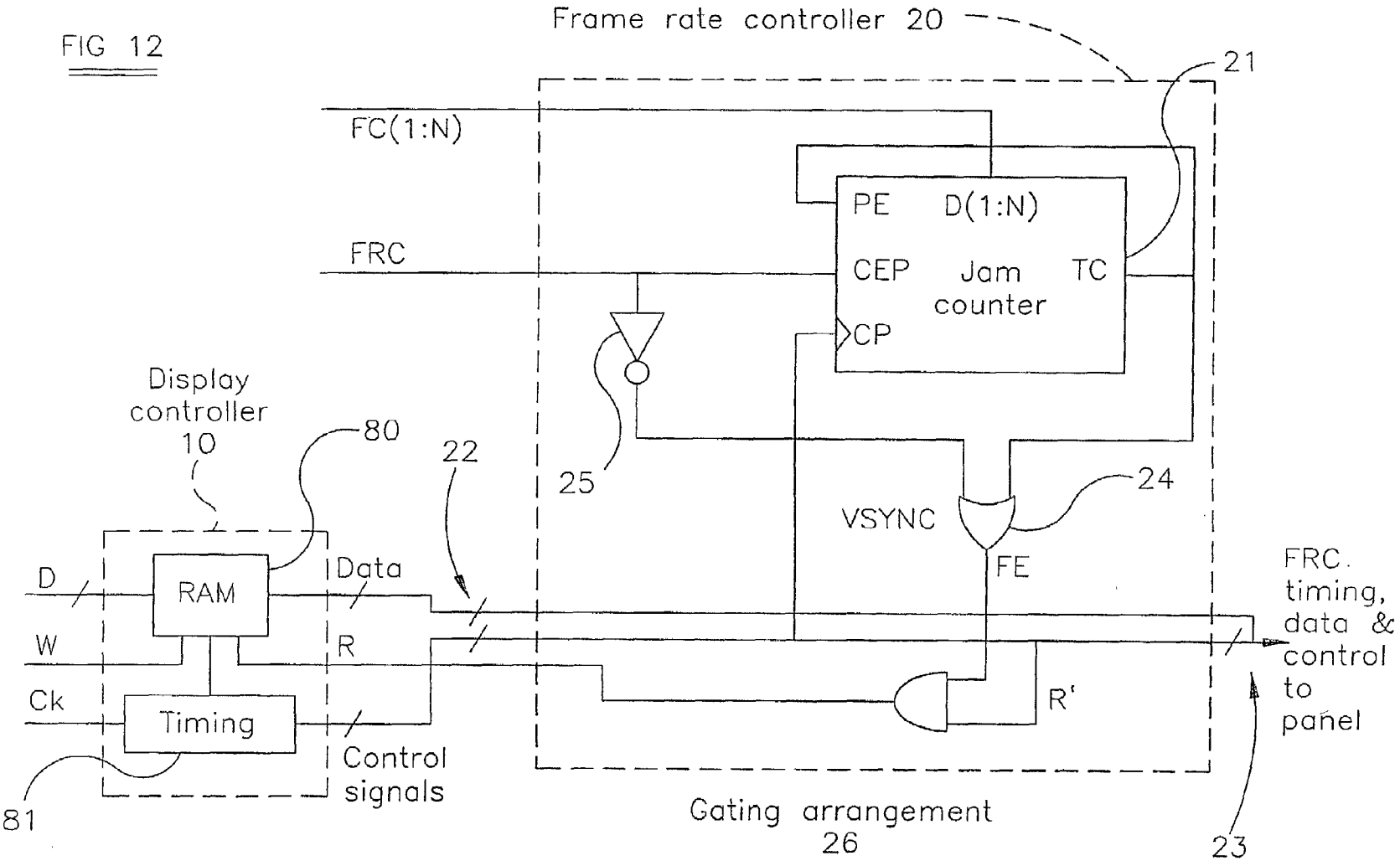
FIG. 12 is a block diagram of a frame rate controller constituting another embodiment of the invention.

FIG. 12 shows another frame rate controller which is similar to that shown in FIG. 3 in that it comprises a counter 21, a gate 24 and an inverter 25 which produce the frame enable signal FE in the same way as described hereinbefore. However, the gating arrangement 26 cooperates with a modified type of display controller 10 comprising a random access memory (RAM) 80 and a timing circuit 81 for controlling operation of the controller 10 and, in particular, read and write operations of the memory 80.

The memory 80 forms a frame buffer memory and has a capacity of at least one frame of image data to be displayed. The memory has data inputs D for receiving data to be displayed, for example from a computer to which the controller 10 is connected or of which the controller 10 is a part. The memory 80 has parallel data outputs connected to the inputs 22 of the controller 20.

The display controller 10 also receives a write signal Wand clock signals Ck from the computer. The write signal W is connected to a write control input of the memory 80 and the clock signals Ck are supplied to the timing circuit 81, which generates timing signals for controlling the operation of the controller 10 and, in particular, for controlling read and write operations of the memory 80. The timing circuit 81 generates control signals which are supplied to the inputs 22 of the frame rate controller 20 and which include a read signal R'. In a known type of controller, the read signal R' would be connected directly to a read input of the memory 80. However, in the arrangement shown in FIG. 12, the conventional read signal R' from the timing circuit 81 is supplied to a first input of an AND gate forming the gating arrangement 26 and having a second input connected to the output of the OR gate 24 to receive the frame enable signal FE. The gating arrangement 26 supplies at its output a gated read signal R, which is returned to the display controller 10 and is connected go the read input of the memory 80.

As described hereinbefore, when frame rate reduction is disabled, the frame enable signal FE remains at the logic high level so that the gating arrangement 26 passes the conventional read signals R' from the timing circuit 81 as the read signal R to the read input of the memory 80. Thus, timing is effectively controlled by the timing circuit 81 and no frame rate reduction occurs.

When frame rate reduction is required, the gate 24 supplies a logic low level signal for (N−1) frame periods and then supplies a logic high level signal for the duration of each Nth frame. The display data are read into the memory 80 in the normal way but the read signal R supplied to the memory 80 only permits reading of the image data during each Nth frame. Thus, the data outputs of the memory are effectively disabled until the frame enable signal FE enables the read signal R.

Although the control signals are shown as being passed without gating from the display controller 10 through the frame rate controller 20 to the display, the control signals may also be gated in the same way as described hereinbefore and as illustrated in FIG. 3. The display is therefore only refreshed by each Nth frame of image data so that its power consumption is substantially reduced.

Figure 13:
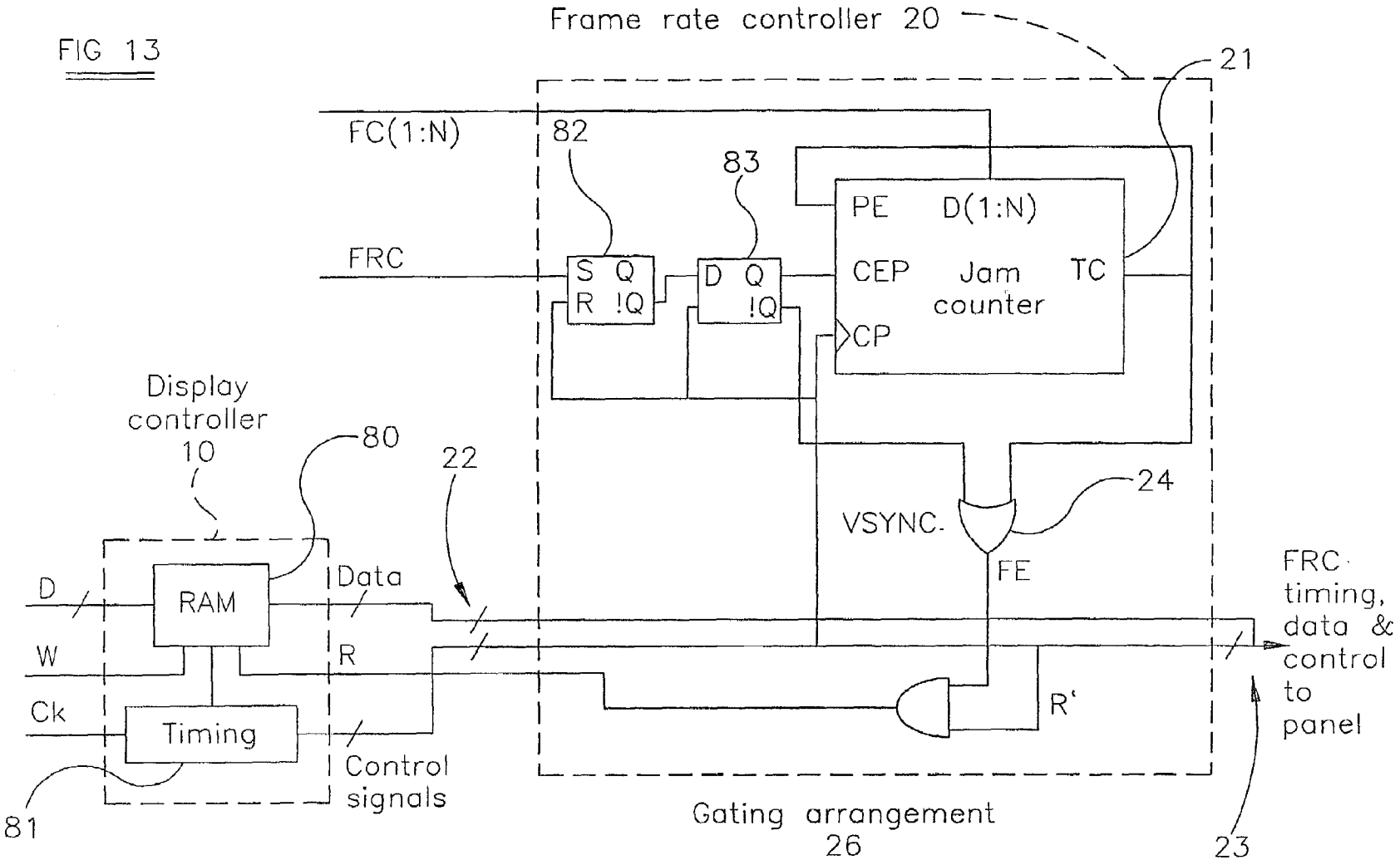
FIG. 13 is a block diagram of a frame rate controller constituting a further embodiment of the invention.

In the embodiments described hereinbefore, the frame rate control signal FRC is generated by any suitable technique to select whether frame rate reduction is to be performed. For example, the signal FRC may be generated in accordance with the type of image data which is to be displayed as described hereinbefore. FIG. 13 illustrates an embodiment which differs that shown in FIG. 12 in that the frame rate control signal FRC is generated automatically from the write control signal W.

The frame rate controller 20 shown in FIG. 13 differs from that shown in FIG. 12 in that the inverter 25 is omitted and the signal FRC is supplied to cascade-connected flip-flops 82 and 83. The signal FRC comprises the write control signal W supplied to the memory 80 of the display controller. This signal is supplied to the set input S of the set/reset flip-flop 82, whose reset input R receives the vertical synchronisation signals supplied to the controller 20 and whose inverted output !Q is connected to the data input D of the D-type flip-flop 83. The flip-flop 83 has a clock input connected to receive the vertical synchronising signals, an output Q connected to the counter enable input CEP of the counter 21, and an inverted output !Q connected to one of the inputs of the OR gate 24.

When fresh data are continuously being supplied to the memory 80 so that the write control signal W is activated between successive vertical synchronisation pulses, the counter 21 is disabled and the value of the write enable signal W set in the flip-flop 82 is clocked into the D-type flip-flop 83 by each vertical synchronisation signal. The write enable signal W is of the "active low" type so that the inverting output !Q of the flip-flop 83 remains at the logic high level and the frame enable signal FE remains at the high level. The read control signals R' are thus passed unmodified as the signals R and the timing circuit 81 controls reading of the memory 80. Thus, no frame rate reduction takes place.

If no data are written to the memory 80 during a frame period, the flip-flop 83 enables the counter 21 and the gating arrangement 26 is controlled by the terminal count output TC of the counter 21 as described hereinbefore. Frame rate reduction is therefore performed as described hereinbefore in accordance with the desired frame rate reduction and this continues unless and until further data are written into the memory 80.

It is thus possible to provide an arrangement in which the frame refresh rate of an active matrix display can be controlled so as to reduce or minimise power consumption of the display. The reduced power consumption is achieved by preventing the display from being refreshed and enabling refreshing at a reduced rate, for example as selected by a display data generation arrangement in accordance with type of data to be displayed. Where a static image is to be displayed, for example for displaying text, the frame refresh rate may be reduced to the minimum value consistent with avoiding observable flicker of the display. The display may be operated at its full refresh rate for, for example, full-colour full-motion video images. Where the image signals are changed at an intermediate rate, the frame refresh rate may be reduced to match the actual video rate. Thus, reduced power consumption can be achieved by a relatively simple arrangement which involves little or no disadvantage in terms of cost of manufacture, complexity and yield rate during manufacture. In the case of battery-powered equipment, the battery life is therefore prolonged.

What is claimed is:

1. A controller for controlling the frame refresh rate of an active matrix display, characterised by comprising: a first circuit responsive to display signals from a display controller for supplying an enable signal (FE) for each Nth frame, where N is an integer greater than zero and is selectable from a plurality of values; and a second circuit for enabling refreshing of the display by each Nth frame supplied to the display controller in response to the enable signal (FE) and for preventing refreshing of the display by each other frame supplied to the display controller in the absence of the enable signal (FE).

2. The controller as claimed in claim 1, characterised in that the display signals include frame synchronization signals (VSYNC) and the first circuit is responsive to each Nth frame synchronization signal (VSYNC).

3. The controller as claimed in claim 1, characterised in that the first circuit is arranged to supply the enable signal (FE) for the duration of each Nth frame.

4. The controller as claimed in claim 3, characterised in that the second circuit is arranged to connect the display to a power supply in response to the enable signal (FE) and to disconnect the display from the power supply in the absence of the enable signal (FE).

5. The controller as claimed in claim 3, characterised in that the second circuit is arranged to gate at least one signal which influences power consumption of the display.

6. The controller as claimed in claim 5, characterised in that the second circuit comprises at least one gate for connection between the display controller and the display.

7. The controller as claimed in claim 6, characterised in that the at least one gate comprises at least one logic gate.

8. The controller as claimed in claim 6, characterised in that the at least one gate comprises at least one transmission gate.

9. The controller as claimed in claim 5, characterised in that the second circuit is arranged to gate a memory read control signal (R') of the display controller.

10. The controller as claimed in claim 5, characterised in that the at least one signal comprises a frame synchronization signal from the display controller.

11. The controller as claimed in claim 5, characterised in that the at least one signal comprises a line synchronization signal from the display controller.

12. The controller as claimed in claim 5, characterised in that the at least one signal comprises at least one image determining signal from the display controller.

13. The controller as claimed in claim 1, characterised in that the first circuit includes means for fixing N at a value greater than one.

14. The controller as claimed in claim 1, characterised in that N is selectable from a plurality of predetermined values.

15. The controller as claimed in claim 1, characterised in that the first circuit has an input (FC (1:N)) for selecting the value of N.

16. The controller as claimed in claim 1, characterised in that the first circuit comprises a preloadable synchronous counter.

17. The controller as claimed in claim 16, characterised in that the counter has a terminal count output (TC) for supplying the enable signal (FE).

18. The controller as claimed in claim 17, characterised in that the counter has a load enable input (PE) connected to the terminal count output (TC).

19. The controller as claimed in claim 16, characterised in that the counter has a clock input (CP) for receiving frame synchronization signals (VSYNC) from the display controller.

20. The controller as claimed in claim 1, characterised by a frame rate reduction enable input (FRC).

21. The controller as claimed in claim 1, wherein the first circuit comprises a preloadable synchronous counter and the counter has a count enable input arranged to be enabled by a rate reduction enable signal at a frame rate reduction enable input (FRC).

22. The controller as claimed in claim 21, characterised in that the count enable input (CEP) is connected to the enable input (FRC).

23. The controller as claimed in claim 21, characterised in that the count enable input (CEP) is connected via a D-type latch (83) and a set/reset flip-flop to the enable input (FRC).

24. The display controller characterised by including a frame refresh rate controller as claimed in claim 1.

25. The display controller as claimed in claim 24, wherein the count enable input is connected via a D-type latch and a set/reset flip-flop to the enable input(FRC) and the enable input(FRC) is connected to receive a memory write control signal of the display controller and the first circuit comprises a preloadable synchronous counter and the counter has a count enable input arranged to be enabled by a rate reduction enable signal at a frame rate reduction enable input(FRC).

26. An active matrix display characterised by including a controller as claimed in claim 1.

27. The display as claimed in claim 26, characterised in that the second circuit of the controller is disposed adjacent an input of the display for receiving the display signals and is arranged to gate all of the display signals.

28. The display as claimed in claim 26, characterised by comprising a plurality of data and scan driver integrated circuits, each of which includes a controller for controlling the frame refresh rate of an active matrix display, characterised by comprising: a first circuit responsive to display signals from a display controller for supplying an enable signal (FE) for each Nth frame, where N is an integer greater than zero and is selectable from a plurality of values; and a second circuit for enabling refreshing of the display by each Nth frame supplied to the display controller in response to the enable signal (FE) and for preventing refreshing of the display by each other frame supplied to the display controller in the absence of the enable signal (FE).

29. The display as claimed in claim 26, characterised by comprising a liquid crystal display.

* * * * *